United States Patent [19]

Schenach

[11] 4,011,166

[45] Mar. 8, 1977

[54] SYNTHETIC LUBRICANT COMPOSITIONS

[75] Inventor: Thomas A. Schenach, Huntington Beach, Calif.

[73] Assignee: Bray Oil Company, Los Angeles, Calif.

[22] Filed: Mar. 10, 1975

[21] Appl. No.: 556,947

[52] U.S. Cl. ..... 252/32.7 E; 252/59; 260/671 G

[51] Int. Cl.[2] ..... C10M 1/16; C10M 1/18

[58] Field of Search ..... 260/671 B, 671 G; 252/59, 32.7 E

[56] References Cited

UNITED STATES PATENTS

| | | | |
|---|---|---|---|
| 3,173,965 | 3/1965 | Pappas et al. | 260/671 |
| 3,288,716 | 11/1966 | Becraft et al. | 252/59 |
| 3,812,036 | 5/1974 | Romine | 252/59 |

*Primary Examiner*—C. Davis

[57] ABSTRACT

Novel synthetic hydrocarbon oils prepared from benzene and olefins and possessing properties uniquely suitable for automobile crankcase lubricants are described.

7 Claims, No Drawings

SYNTHETIC LUBRICANT COMPOSITIONS

This invention relates to synthetic hydrocarbon compositions prepared from benzene and possessing properties which make them ideally suited for the formulation of automobile crankcase oils, and similar products.

BACKGROUND

One of the most basic requirements for any lubricating oil is the proper viscosity for the purpose intended. Automobiles operating in moderate climates normally employ crankcase oils with a viscosity of from 9.6 to 12.9 centistokes at 210° F. (98.9° C.). Such oils are commonly designated SAE 30 in accordance with the viscosity classification system established by the Society of Automotive Engineers. The designation SAE 20 defines a less viscous oil, with a viscosity of between 5.7 and 9.6 centistokes at 210° F. Many turbine lubricants have similar viscosity requirements, 5 to 7 centistokes at 210° F. being a representative range.

Most automobile crankcase oils are formulated from petroleum base oils derived from crude oil by distillation, extraction and other conventional refining techniques. One such oil, a solvent treated neutral oil called 300 Neutral and supplied by the Union Oil Corporation, has a kinematic viscosity of about 8 centistokes at 210° F. and about 70 centistokes at 100° F. (37.8° C.). Its viscosity index is 88. Such an oil can be blended with other oils and suitable additives to produce either an SAE 20 or 30 motor oil or turbine lubricant, as is well known to workers skilled in the art of lubricating oil compounding.

One drawback of petroleum base oils such as the aforementioned 300 Neutral is their tendency to solidify at low temperatures. Thus, 300 Neutral has a pour point of 10° F. (−12° C.). The problem, of course, is the presence in the oil of waxy paraffinic constituents with relatively high melting points. These waxes can be removed to some extent by various "de-waxing" processes. Instead of removing the wax, as an alternative, additives called pour point depressants can be added to the formulation to lower the solidification point. But increasing interest is also being shown in the use of wax-free synthetic base oils — that is, oils prepared by chemical reaction rather than crude oil refining — in place of the petroleum base stocks. Two classes of synthetic hydrocarbon are receiving considerable attention, in the area of crankcase oils and turbine lubricants. The first class consists of the linear alpha-olefin oligomers, such as the trimers, tetramers, and higher polymers of n-decene-1, $CH_3 - (CH_2)_7CH{=}CH_2$. These may be prepared by reacting the olefin with conventional polymerization catalysts, such as anhydrous aluminum chloride, organic peroxides, boron trifluoride with promoters such as water, alcohols, or carboxylic acids, and "Ziegler-type" systems such as alkylaluminum halides in combination with titanium halides. Processes for preparing oligomer oils are disclosed by many workers, including Pratt U.S. Pat. No. 3,842,134, Montgomery et al U.S. Pat. No. 2,559,984, Hamilton et al U.S. Pat. No. 3,149,178, Brennan U.S. Pat. No. 3,769,363, and Smith et al U.S. Pat. No. 3,682,823. The second class consists of the dialkylbenzenes, such as di-dodecylbenzene, $(C_{12}H_{25})_2C_6H_4$. These may be prepared by the Friedel-Crafts reaction, wherein benzene is reacted with an olefin or alkyl halide containing the appropriate number of carbon atoms in the presence of a catalyst such as anhydrous aluminum chloride or boron trifluoride. Pappas, U.S. Pat. No. 3,173,965, Bray et al U.S. Pat. No. 3,544,472, Becraft et al U.S. Pat. No. 3,288,716, and others have disclosed processes for the manufacture of dialkylbenzenes. Both the oligomer oils and the dialkylbenzenes offer significant advantages over a conventional petroleum base oil such as 300 Neutral; namely, low pour points, usually −60° F. (−51.1° C.), or below, high viscosity indices (usually 100–110 for dialkylbenzenes, 120–140 for the oligomer oils), and (frequently) better oxidation stability.

Inasmuch as many of the substances capable of polymerizing linear alpha-olefins to form oligomer oils are also catalysts for the addition of olefins to benzene, previous workers have attempted to combine the two reactions and react olefins with benzene in such a way as to effect both polymerization and benzene alkylation. Boux de Casson et al U.S. Pat. No. 2,518,529 describe the simultaneous alkylation and polymerization of a cracked distillate-benzene mixture in the presence of anhydrous aluminum chloride. A representative product of their process had the following properties: a kinematic viscosity of 25.6 centistokes at 100° F. and 4.6 centistokes at 210° F. (calculated from the reported viscosity index of 103); a pour point of −30° C. (−22° F.); an iodine number of 4. Antonsen and Hirschler, U.S. Pat. No. 3,104,267, disclose the polymerization of a linear alpha-olefin in the presence of benzene, using a mixture of titanium tetrachloride and ethyl aluminum dichloride. When polymerization was complete, dry hydrogen chloride or bromide was introduced, thereby causing alkylation of the benzene by the oligomer mixture formed in the first step. A representative product had a viscosity of 48.14 centistokes at 100° F., a viscosity of 6.89 centistokes at 210° F. (calculated from the reported viscosity index of 108), a bromine number of 0.5, and a pour point of +20° F. which is undesirably high. Both these references suggest the desirability of obtaining a product with a minimum of residual unsaturation — that is, an oil wherein the double bonds of the starting olefin and polyolefins formed therefrom have substantially been eliminated by reaction with the benzene, and the final bromine or iodine number is low.

On the other hand, Romine U.S. Pat. No. 3,812,036 discloses a combination polymerization-alkylation process wherein he seeks to avoid the complete elimination of olefinic products. Romine reacts benzene with a linear alpha-olefin in the presence of an aluminum chloride-nitromethane mixture to obtain an oil preferably comprising between 20 to 50% alkylated benzene compounds and from 50 to 80% olefin oligomers. These products have viscosities in the range of 5 to 6 centistokes at 210° F., 27 to 34 centistokes at 100° F., viscosity indices of 130 to 134, and pour points below −65° F. He contends that the presence of the olefinic products is beneficial in view of the teachings of his earlier patent, U.S. Pat. No. 3,808,134, wherein mixtures of alpha-olefinic oligomers with dialkylbenzenes are claimed to exhibit superior viscosity-temperature properties when compared to either the oligomers or the dialkylbenzenes by themselves. The presence of significant olefinic unsaturation in these oils would, however, be expected to have an adverse effect on the oxidation stability of lubricants formulated therefrom; and, in fact, linear alpha-olefin oligomers are normally hydrogentated to remove residual unsaturation before use — see, for example, Smith et al U.S. Pat. No. 3,682,823, already cited above.

It must be noted at this point that, by means of the polymerization-alkylation process of U.S. Pat. No. 3,812,036, Romine did obtain three products from n-decene-1 and benzene which contained little or no residual unsaturation. The most viscous of these had a viscosity of 7.79 centistokes at 210° F., 54.02 centistokes at 100° F., a pour point of −65° F., and a viscosity index of 120. These oils are the closest in properties to those of my invention that I am able to locate in the prior art, although my compositions will be seen to be superior thereto and patentable thereover.

BRIEF SUMMARY OF THE INVENTION

I have now found that by careful control of reaction conditions, linear alpha-olefins containing from 8 to 12 carbon atoms may be reacted with benzene in an alkylation-polymerization process to yield synthetic hydrocarbon oils with the following properties:

1. Kinematic viscosities of about 8 centistokes or higher at 210° F. (98.9° C.).
2. Viscosity indexes of between 120 and 135.
3. Pour points of −60° F. (−51.1° C.) or below.
4. Compatibility with conventional automobile crankcase oil and turbine lubricant additives.
5. Low residual unsaturation as indicated by bromine numbers of less than 1.0 and more usually less than 0.5.
6. Good oxidation stability comparable or superior to that of conventional petroleum base oils such as Union 300 Neutral.

The products of my invention may usefully be substituted for conventional oils such as the 300 Neutral oil described hereinabove in the formulation of crankcase oils and turbine lubricants.

REACTION CONDITIONS

The linear alpha-olefins most useful in my invention are those most employed in the manufacture of oligomer oils; namely, n-octene-1, n-nonene-1, n-decene-1, n-undecene-1, n-dodecene-1, and mixtures thereof. Decene and dodecene are preferred. Aromatic compounds other than benzene, somewhat surprisingly, do not yield the desired type of product oil under the process conditions of my invention. The preferred alkylation-polymerization catalyst is anhydrous aluminum chloride.

In order to obtain products within the desired viscosity range, the reaction conditions must be carefully controlled. The aluminum chloride catalyst should be present in a ratio of from about 0.08 to 0.15 moles per mole of benzene, and from about 0.06 to 0.15 moles per mole of olefin. Lower concentrations of catalyst tend to produce lower viscosity products. Concentrations of catalyst higher than 0.15 may be employed, but it is more difficult to handle aluminum chloride when it is present in these larger amounts and, therefore, I prefer to keep its concentration at or below this limit. The olefin to benzene ratio is also important, a molar ratio of one to one being most preferred. Higher olefin/benzene ratios result in a less viscous product. Lower olefin/benzene ratios may result in a product with a lower viscosity index. Reaction temperature also affects the product viscosity, higher temperatures tending to yield a higher viscosity product. A reaction temperature between about 140° F. (60° C.) and 190° F. (87.8° C.) is preferred, the latter temperature being high enough to cause refluxing of the benzene. The order of addition is also important, the aluminum chloride being added to the benzene with agitation in order to form a slurry, and a linear alpha-olefin being added thereto. Whereas in conventional Friedel-Crafts alkylation processes, many workers recommend the addition of trace amounts of promoters such as hydrogen chloride or water to the aluminum chloride, I have not found it necessary to the process of my invention. The traces of moisture in my reactants are apparently sufficient to promote my reaction, if indeed such promotion is actually necessary.

The isolation of the product oils from my reaction mixtures is carried out by conventional procedures such as are normally employed in aluminum chloride reactions. When the reaction itself is essentially completed, the mixture is allowed to stand without agitation, whereupon the spent aluminum chloride rapidly settles to the bottom in the form of a reddish fluid sludge containing some organic material in addition to the metal salts. This sludge is removed and the reaction mixture is washed with a moderately strong alkaline solution, such as 20% aqueous sodium hydroxide, in order to remove residual aluminum salts and HCl. The reaction mixture is usually washed again, this time with water, in order to remove residual sodium hydroxide, and then subjected to vacuum or steam distillation in order to remove unreacted starting materials and low boiling byproducts. These byproducts consisting mainly of simple monoalkyl benzenes — that is, compounds like decyl-benzene produced by addition of one mole of olefin to one mole of benzene. The term "simple" is used to differentiate these materials from monoalkyl benzenes wherein the alkyl group is derived from a dimer, trimer, or other oligomer of the starting olefin, such as $C_{20}H_{41}C_6H_5$. The compositions of my invention are left as the residue or "bottoms" fraction from the distillation. The yield is normally above 50% and often between 60 and 70% of the weight of the linear alpha-olefin feedstock.

The preparation of the compositions of my invention is illustrated by the following examples:

EXAMPLE 1

To a roundbottomed flask equipped with stirrer, thermometer, reflux condenser, and additional funnel was charged 1560 grams (20 moles) of benzene followed by 210 grams (1.6 moles) of anhydrous aluminum chloride. The mixture was warmed with agitation to 120° F. (48.9° C.) as 2800 grams (20 moles) of n-decene-1 was started in dropwise. The reaction gradually turned from yellow to a dark red, and small aounts of hydrogen chloride were evolved. The temperature rose to 140° F. (60° C.) and was maintained at that point by occasional application of a cooling water bath and regulation of the rate of addition of the decene. When the olefin addition was complete, the reaction was stirred an additional hour to insure completion, and then allowed to stand for separation of aluminum chloride sludge. After the bulk of the catalyst had settled to the bottom, and been removed, the reaction mixture was washed and distilled to obtain 1650 grams of product boiling above 369° F. at 0.5 mm. of mercury pressure. This product had the following properties:

| | |
|---|---|
| API Gravity | 34.1 |
| Viscosity at 100° F. | 52.08 centistokes |
| Viscosity at 210° F. | 7.97 centistokes |
| Viscosity Index | 131 |

-continued

| | |
|---|---|
| Bromine Number | 0.16 |
| Pour Point | −65° F. |
| Flash Point | 425° F. |
| Fire Point | 460° F. |

The yield was 59%, based on the weight of olefin charged. It should be noted that the product of Example 1 is markedly superior in viscosity-temperature characteristics to that disclosed by Romine, U.S. 3,812,036, and described hereinabove. Thus, Romine's oil has a viscosity index of only 120, whereas the product of Example 1 has a viscosity index of 131.

EXAMPLE 2

In this run, the sample ratios of benzene, n-decene-1, and aluminum chloride were employed as in Example 1, but a higher reaction temperature was used. A slurry of 53 grams (0.4 moles) of aluminum chloride in 390 grams (5 moles) of benzene was prepared, and 700 grams (5 moles) of olefin started in. The temperature was allowed to climb to 180°–195° F., at which point gentle refluxing of the benzene occurred. When the reaction was complete, the mixture was allowed to settle, and 94 grams of aluminum chloride sludge was withdrawn. The rest of the mixture was washed and vacuum-distilled to yield 200 grams recovered benzene, 400 grams monodecyl-benzenes, and 400 grams of product oil with the following properties:

| | |
|---|---|
| API Gravity | 34.1 |
| Viscosity at 100° F. | 62.26 centistokes |
| Viscosity at 210° F. | 8.95 centistokes |
| Bromine Number | 0.5 |
| Viscosity Index | 131 |
| Yield | 56% |

EXAMPLE 3

In this run, 840 grams (5 moles) of n-dodecene-1 was substituted for the 700 grams of n-decene-1 in the run of Example 2. The product had the following properties:

| | |
|---|---|
| API Gravity | 34.0 |
| Viscosity at 100° F. | 64.46 centistokes |
| Viscosity at 210° F. | 9.34 centistokes |
| Viscosity at −40° F. | 32,276 centistokes |
| Bromine Number | 0.2 |
| Pour Point | −60° F. |
| Viscosity Index | 134 |

It is somewhat surprising to note that the product of dodecene has almost the same physical properties as that from decene in spite of the two-carbon difference.

EXAMPLE 4

This run illustrates the pour point problems that are encountered when olefins with more than 12 carbon atoms are employed. To a slurry of 53 grams (0.4 moles) of aluminum chloride in 390 grams (5 moles) of benzene was added 980 grams (5 moles) of n-tetradecene-1. The addition was carried out at 140° F. as for Example 1. The product had the following properties:

| | |
|---|---|
| API Gravity | 34.3 |
| Viscosity at 100° F. | 107.98 centistokes |
| Viscosity at 210° F. | 14.19 centistokes |
| Bromine Number | 0.2 |
| Pour Point | +10° F. |
| Viscosity Index | 144 |

The undesirably high pour point of this material would be a serious drawback to its use in many formulations.

EXAMPLE 5–6

In these runs, 560 grams (5 moles) of n-octene-1 was added to a slurry of 53 grams (0.4 moles) of aluminum chloride in the 390 grams (5 moles) of benzene. In Example 5, the reaction was carried out at 140° F.; in Example 6, the reaction was carried out at 190° F. The two products had the following properties:

| | |
|---|---|
| Example 5 | |
| API Gravity | 34.1 |
| Viscosity at 100° F. | 34.05 centistokes |
| Viscosity at 210° F. | 5.70 centistokes |
| Viscosity Index | 118 |
| Bromine Number | 0.2 |
| Example 6 | |
| Viscosity at 100° F. | 88.42 centistokes |
| Viscosity at 210° F. | 10.99 centistokes |
| Viscosity Index | 120 |
| Bromine Number | 0.2 |
| Flash Point | 490° F. |

A dramatic increase in viscosity was achieved by raising the reaction temperature from 140° to 190° F. However, both the yield of these products (38% of the weight of octene charged in both Example 5 and 6) and the viscosity indexes are relatively low, compared to the oils from decene and docene already disclosed. Thus, compositions from the latter two olefins appear to represent the most preferred embodiments of my invention.

Further examples of my invention are summarized in Table 1.

TABLE 1

Alkylations of Benzene With 1 Decene

| Example | Decene (moles) | Benzene (moles) | $AlCl_3$ (mole) | Approx. Temp. ° F. | (° C) | Viscosity at 100° F. Centistokes | Viscosity at 210° F. Centistokes | Index | Br.No. |
|---|---|---|---|---|---|---|---|---|---|
| 7 | 6.5 | 5 | 0.4 | 140 | (60) | 48.59 | 7.58 | 132 | 0.5 |
| 8 | 5 | 7.5 | 0.4 | 140 | (60) | 54.23 | 7.96 | 125 | 0.4 |
| 9 | 5 | 5 | 0.2 | 140 | (60) | 42.47 | 6.82 | 128 | 0 |
| 10 | 5 | 5 | 0.5 | 190 | (87.8) | 72.42 | 10.03 | 131 | 1.0 |
| 11 | 7 | 5 | 0.4 | 190 | (87.8) | 53.44 | 8.02 | 130 | 0.3 |
| 12 | 7 | 5 | 0.65 | 190 | (87.8) | 54.05 | 8.23 | 135 | 0.4 |

TABLE 1-continued

| Alkylations of Benzene With 1 Decene | | | | | | | | | |
|---|---|---|---|---|---|---|---|---|---|
| Example | Decene (moles) | Benzene (moles) | $AlCl_3$ (mole) | Approx. Temp. °F. | (°C) | Viscosity at 100° F. Centistokes | Viscosity at 210° F. Centistokes | Index | Br.No. |
| 13 | 5 | 5 | 0.65 | 190 | (87.8) | 83.81 | 11.08 | 130 | 0.9 |

Notes:
Kenamatic viscosities were determined in a Cannon-Fenske viscosimeter, ASTM Method D-445.
Viscosity indexes were determined according to ASTM Method D-2270.
Bromine numbers were determined according to ASTM Method D-1158.

The chemical composition and molecular structure of the oils of my invention are not entirely understood. They appear to be polyolefin chains substituted with aromatic rings. The low bromine numbers suggest little, if any, polyolefin components, per se, and the high viscosity indexes suggest that these are not ordinary dialkylbenzenes. A rough material balance calculation on the product of Example 10 suggested an average formula of $C_{30}H_{60}C_6H_5$, but I do not know what chemical entities may be contributing thereto. The important thing, of course, is the preparations are reproducible and the same olefin-benzene-catalyst mixtures reacted at the same temperature will yield products with essentially the same viscosity properties.

Example 14 illustrates the toluene does not behave the same way as benzene when subjected to the conditions of my invention.

EXAMPLE 14

To a slurry of 5 moles of toluene and 0.4 moles of aluminum chloride was slowly added 5 moles of 1-decene at a reaction temperature of 180°–190° F. The addition took 1½ hours. The mixture was stirred an additional 30 minutes to insure completeness of reaction and then it was worked up as usual. A yield of 330 grams of product boiling above 383° F. at 0.4 mm of Hg was obtained. It had the following properties: a bromine number of 0.5, a kinematic viscosity of 40.24 centistokes at 100° F. and 6.09 centistokes at 210° F., and a viscosity index of 106.

The lower viscosities and viscosity index suggest that this product is closer in its chemical composition to the normal dialkylbenzenes such as those described by Pappas U.S. Pat. No. 3,173,965 than to the products of Examples 1–13.

Uses

The synthetic oil compositions of my invention are eminently suited to the formulation of SAE 20 and SAE 30 automobile crankcase oils and turbine lubricants as illustrated by the following examples:

EXAMPLE 15

An SAE 20 automobile crankcase oil was formulated as follows:

| | |
|---|---|
| 3% | Calcium overbased sulfonate (Alkali value 297 mg.KOH/gm.) |
| 2% | Calcium neutral sulfonate |
| 4% | Zinc diaryldithiophosphate (3.15% Zn, 5.93%, P 2.85%) |
| 91% | Product from Example 1. |

This oil had a viscosity of 60.77 centistokes at 100° F.

EXAMPLE 16

In this example, a commercial crankcase oil additive package, L-3817 (manufactured by the Lubrizol Corporation, Cleveland, Ohio), was added in the recommended 10.8 wt. % concentration to the product oil of Example 3 to form an SAE 30 automobile oil. This oil had the following properties:

| | |
|---|---|
| Viscosity at 100° F. | 81.34 centistokes |
| Viscosity at 210° F. | 11.02 centistokes |
| Viscosity Index | 134 |
| Analysis: | |
| Zinc | 0.09 wt. % |
| Calcium | 0.2 wt. % |
| Phosphorus | 0.08 wt. % |
| Sulfur | 0.27 wt. % |
| Alkali Value | 6.05 mg.KOH/g. |

This oil was clear and flowed readily at −40° F. For comparison, a second formulation was made up containing 10.8% L-3817 in 300 Neutral oil. This formulation was, of course, completely frozen at −40° F.

The two oils were subjected to the "five-metal" corrosion-oxidation stability test for 72 hours at 347° F.

This procedure is described in Federal Test Method Standard No. 791B, Method No. 5308, and is basically carried out as follows: Polished specimens of copper, steel, aluminum, magnesium, and silver are immersed in the oil to be tested and a slow stream of air is bubbled through at a prescribed rate while the oil is maintained at the required temperature for the required length of time. When the test period is completed, the oil is examined for evidence of oxidative degradation — for example, a large increase or decrease in viscosity and a large deposit of sludge. The following results were obtained in this test when the SAE 30 oil prepared from the product of Example 3 was compared with that prepared from 300 Neutral.

| | |
|---|---|
| Example 3 | |
| Viscosity Increase | 4.7% |
| Sludge | 0.02% |
| 300 Neutral | |
| Viscosity Increase | 22.27% |
| Sludge | negligible |

The formulation prepared from the product of my invention gave a considerably smaller viscosity increase and only a slightly higher amount of sludge than the formulation based on the conventional petroleum base oil.

As would be obvious to workers skilled in the art, the compositions of my invention may be used in other types of lubricant formulation such as turbine oils, hydraulic fluids, gear oils, automatic transmission fluids, and so on. By the addition of appropriate thickening agents, such as bentonite, silica aerogel, calcium, lithium and sodium soaps of fatty acids, they may be converted to greases. They may also be subjected to catalytic hydrogenation in order to improve their oxidation stability.

The hydrogenation may be carried out by techniques well known in the art, using elevated temperatures and pressures and suitable catalysts such as nickel on kieselguhr, platinum oxide, and rhodium on charcoal. A representative hydrogenation is described in Example 17.

EXAMPLE 17

Nine hundred grams of a composite mixture of octene, decene, and dodecene-alkylated benzenes prepared by the process of my invention was subjected to catalytic hydrogenation for two hours at 400° F. (204.4° C) and 1000 psig, hydrogen pressure, using 45 grams of a commercial nickel-on-kieselguhr catalyst. The properties of the oil before and after hydrogenation are listed below:

| | Before Hydrogenation | After Hydrogenation |
|---|---|---|
| Viscosity | | |
| 100° F. | 57.35 centistokes | 82.19 centistokes |
| 210° F. | 8.51 centistokes | 10.43 centistokes |
| −40° F. | 28,500 centistokes | 75,000 centistokes |
| Viscosity Index | 132 | 121 |
| Appearance | Yellow | Colorless |

The hydrogenated product was considerably more viscous and had a lower viscosity index. Thus, my oils behave somewhat differently than the dialkylbenzenes of Pappas, U.S. Pat. No. 3,173,965, which showed an increase in viscosity index as well as viscosity when hydrogenated.

The examples given hereinabove are furnished for the purpose of illustration only, and are not meant to be limiting within the boundaries of the following claims.

I claim:

1. A synthetic hydrocarbon lubricating oil composition possessing a minimum viscosity of about 8 centistokes at 210° F. (98.9° C.), a maximum pour point of about −60° F. (−51.1° C.), a maximum bromine number of about 1.0, a viscosity index of between 120, and 135, and a flash point of at least 400° F. (204.4° C.), said lubricant composition being prepared by the following process:

1. forming an admixture of benzene and anhydrous aluminum chloride in a ratio of one mole of benzene to about 0.08 to 0.15 mole of aluminum chloride;
2. adding thereto a linear alpha-olefin containing from 8 to 12 carbon atoms at a temperature sufficient to cause polymerization of the olefin and alkylation of the benzene by the olefin and polymers thereof, the ratio of olefin to benzene being between about 0.6 to 1.5 moles of olefin per mole of benzene and the ratio of aluminum chloride to olefin being between about 0.06 and 0.15 moles of aluminum chloride to one mole of olefin.
3. removing the aluminum chloride and distilling the reaction mixture to remove therefrom unreacted starting materials and simple monoalkyl benzenes, thereby obtaining the desired synthetic hydrocarbon lubricant composition.

2. The composition of claim 1 wherein the linear alpha-olefin is decene-1.

3. The composition of claim 1 wherein the linear alpha-olefin is n-dodecene-1.

4. The composition of claim 1 wherein the alkylation is carried out at the reflux temperature of benzene.

5. The lubricating oil composition prepared by subjecting the composition of claim 1 to catalytic hydrogenation.

6. A crankcase motor oil with a viscosity range of SAE 20 to SAE 30, said motor oil containing a major amount of the lubricant composition of claim 1 in admixture with 1–4% zinc dithiophosphate antiwear additives.

7. A crankcase motor oil with a viscosity range of SAE 20 to SAE 30, said motor oil containing a major amount of the lubricant composition of claim 5 in admixture with 1–4% zinc dithiophosphate antiwear additives.

* * * * *